US006668607B1

(12) United States Patent
Huang

(10) Patent No.: US 6,668,607 B1
(45) Date of Patent: Dec. 30, 2003

(54) LOCK CORE

(76) Inventor: Chiu-Mei Huang, P.O. Box 90, Tainan City (TW)

( * ) Notice: Subject to any disclaimer, the term of this patent is extended or adjusted under 35 U.S.C. 154(b) by 0 days.

(21) Appl. No.: 10/361,638

(22) Filed: Feb. 11, 2003

(51) Int. Cl.[7] ..... E05B 9/04; E05B 25/00
(52) U.S. Cl. ..... 70/375; 70/386; 70/417; 70/493
(58) Field of Search ..... 70/1.5, 375, 386, 70/397, 399, 401, 409, 417, 493

(56) References Cited

U.S. PATENT DOCUMENTS

| | | | | | |
|---|---|---|---|---|---|
| 3,130,573 | A | * | 4/1964 | Hines | 70/417 |
| 3,429,154 | A | * | 2/1969 | Schwartz | 70/375 |
| 3,531,959 | A | * | 10/1970 | Weber | |
| 4,078,406 | A | * | 3/1978 | Genakis | 70/378 X |
| 5,086,632 | A | * | 2/1992 | Hsu | 70/375 |
| 5,131,247 | A | * | 7/1992 | Hsu | 70/358 |
| 5,475,997 | A | * | 12/1995 | Chung | 70/375 |
| 5,671,623 | A | * | 9/1997 | Hsu | 70/375 |
| 5,893,284 | A | * | 4/1999 | Hrabal | 70/358 |

FOREIGN PATENT DOCUMENTS

| | | | | |
|---|---|---|---|---|
| DE | 3503154 | * | 8/1986 | 70/493 |
| FR | 470155 | * | 6/1914 | 70/493 |
| GB | 1545294 | * | 5/1979 | 70/375 |
| JP | 164985 | * | 6/1990 | 70/417 |

* cited by examiner

*Primary Examiner*—Lloyd A. Gall

(57) ABSTRACT

A lock core includes a lower and an upper lock cover and a lock plate. The upper lock cover has the recessed hollow provided with a plurality of recessed holes respectively fitted therein with at least one steel ball. Thus, when a burglar employs an electric drill to break and unlock a lock by drilling through the keyhole of the lock, the steel balls in the recessed holes can stop the electric drill from drilling forward, having excellent effect of anti-theft.

4 Claims, 3 Drawing Sheets

LOCK CORE

BACKGROUND OF THE INVENTION

1. Field of the Invention

This invention relates to a lock core, particularly to one having a plurality of recessed holes bored in the recessed hollow of an upper lock cover for respectively receiving at least one steel ball therein. Thus, when a burglar employs an electric drill to break and unlock a lock by drilling through the keyhole of the lock, the steel balls in the recessed holes can stop the electric drill from drilling forward, having excellent effect of anti-theft.

2. Description of the Prior Art

A conventional lock core 1, as shown in FIG. 1, is composed of a lower lock cover 10, a lock plate 11 and an upper lock cover 12. The lower lock cover 10, the lock plate 11 and the upper lock cover 12 are respectively formed with a curved groove passage 13 matching with one another. The lower lock cover 10 is formed with a recessed hollow 14 at the upper portion and a keyhole 15 at one end. The upper lock cover 12 is bored with a plurality of pinholes 16 in the groove passage 13 for pins 17 to be respectively inserted therein. In assembling, the lock plate 11 is first deposited in the recessed hollow 14 of the lower lock cover 10 and then the upper lock cover 12 is covered on the lock plate 11, letting the groove passage 13 of the lower lock cover 10, the plate 11 and the upper lock cover 12 aligned to one another. Lastly, a clasp 18 is engaged in the corresponding clasping holes 19 respectively provided at the opposite ends of the lower and the upper lock cover 10, 12 to finish assembly of the lock core. However, such a conventional lock core 1 is easy to be broken by an electric drill, which a burglar employs to drill through the keyhole 15 of the lock.

SUMMARY OF THE INVENTION

The objective of invention is to offer a lock core able to guard against being broken by an electric drill drilling through the keyhole of a lock.

The feature of the invention is that an upper lock cover has its recessed hollow provided with a plurality of recessed holes respectively fitted therein with at least one steel ball.

BRIEF DESCRIPTION OF DRAWINGS

This invention will be better understood by referring to the accompanying drawings, wherein.

DETAILED DESCRIPTION OF THE PREFERRED EMBODIMENT

Figure 1:
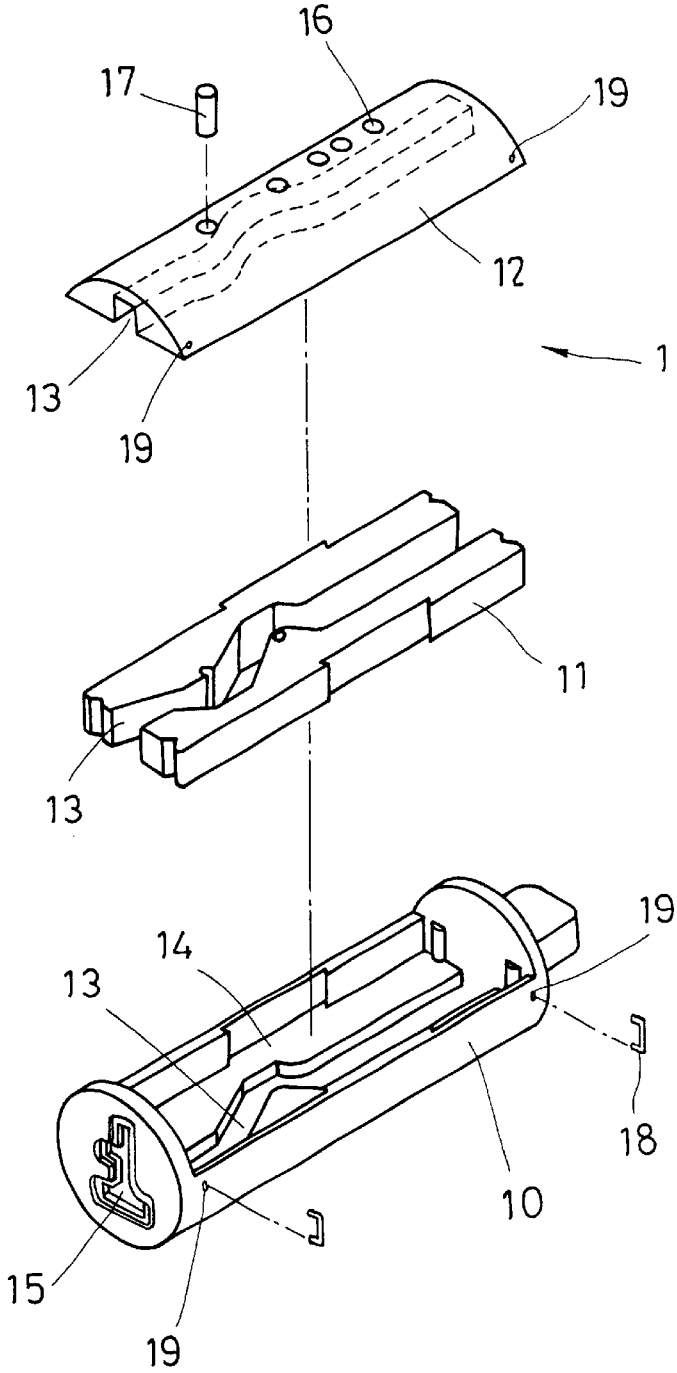
FIG.1 (PRIOR ART)
FIG. 1 is an exploded perspective view of a conventional lock core.
Figure 2:
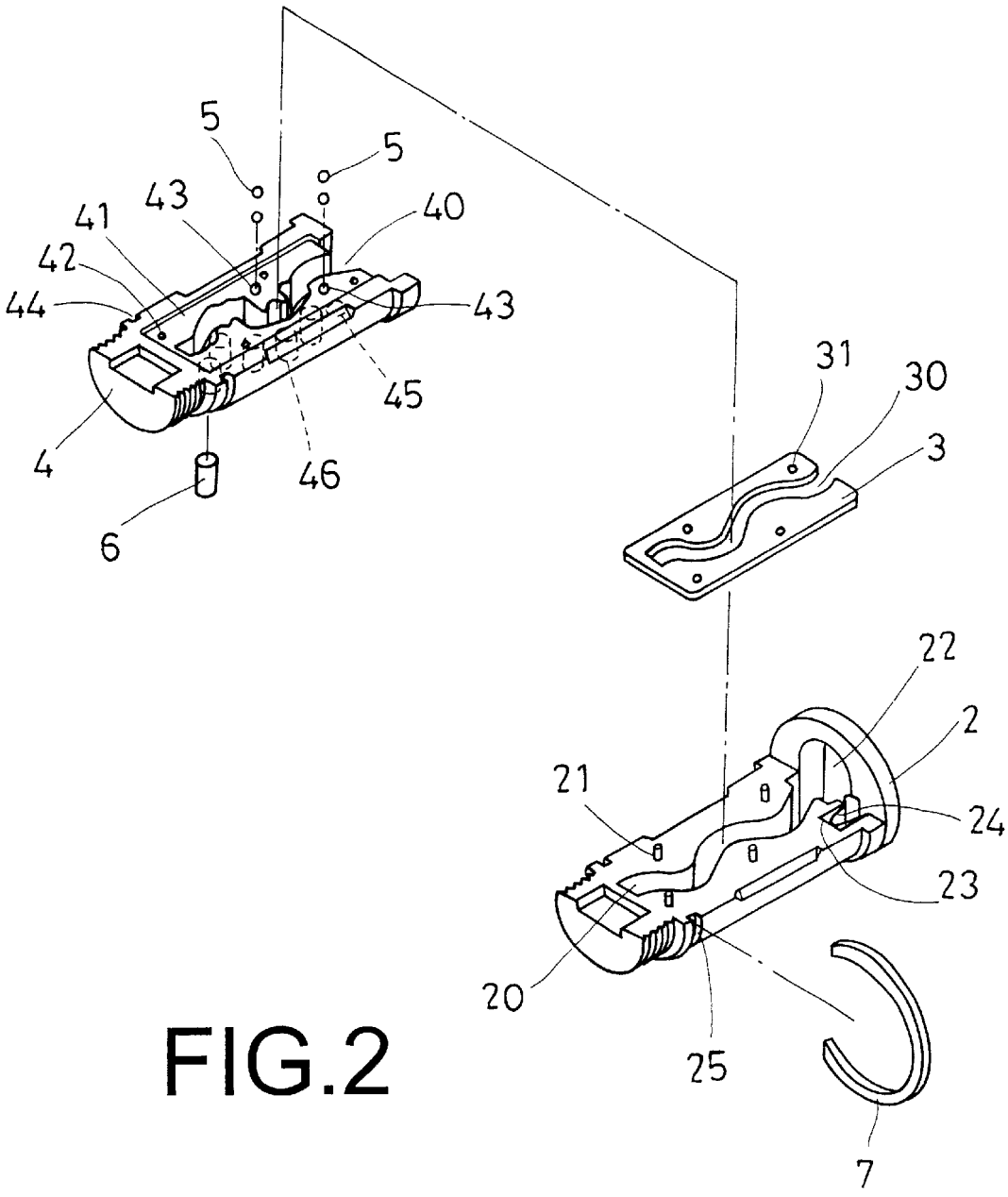
FIG. 2 is an exploded perspective view of a lock core in the present invention; and, FIG. 3 is cross-sectional view of the lock core in the present invention.

A preferred embodiment of a lock core in the present invention, as shown in FIG. 2, includes a lower lock cover 2, a lock plate 3 and an upper lock cover 4 combined together. The lower lock cover 2, the lock plate 3 and the upper lock cover 4 are respectively formed with a curved groove passage 20, 30, 40 matching with one another.

The lower lock cover 2 has a plurality of projections 21 provided at the upper side and a keyhole 22 formed at one end. The keyhole 22 has its inner sidewall bored with a notch

23 fitted therein with an elastic clasp 24 for clasping and holding a key. Further, the lower lock cover 2 is formed with a semi-annular clasping groove 25 around an inner end.

The lock plate 3 to be positioned between the lower lock cover 2 and the upper lock cover 4 is bored with plural insert holes 31 matching with the projections 21 of the lower lock cover 2.

The upper lock cover 4 to be assembled on the lower lock cover 2 is formed with a recessed hollow 41 having a plurality of small recesses 42 and recessed holes 43. The small recesses 42 conform to the projections 21 of the lower lock cover 2, and the recessed holes 43 are respectively fitted therein with at least one steel ball 5. The upper lock cover 4 further has a semi-annular clasping groove 44 formed around an inner end to correspond to the clasping groove 25 of the lower lock cover 2, and a pin recess 45 formed at one edge and plural pin holes 46 provided in the groove passage 40 for lock pins 6 to be respectively inserted therein.

Figure 3:
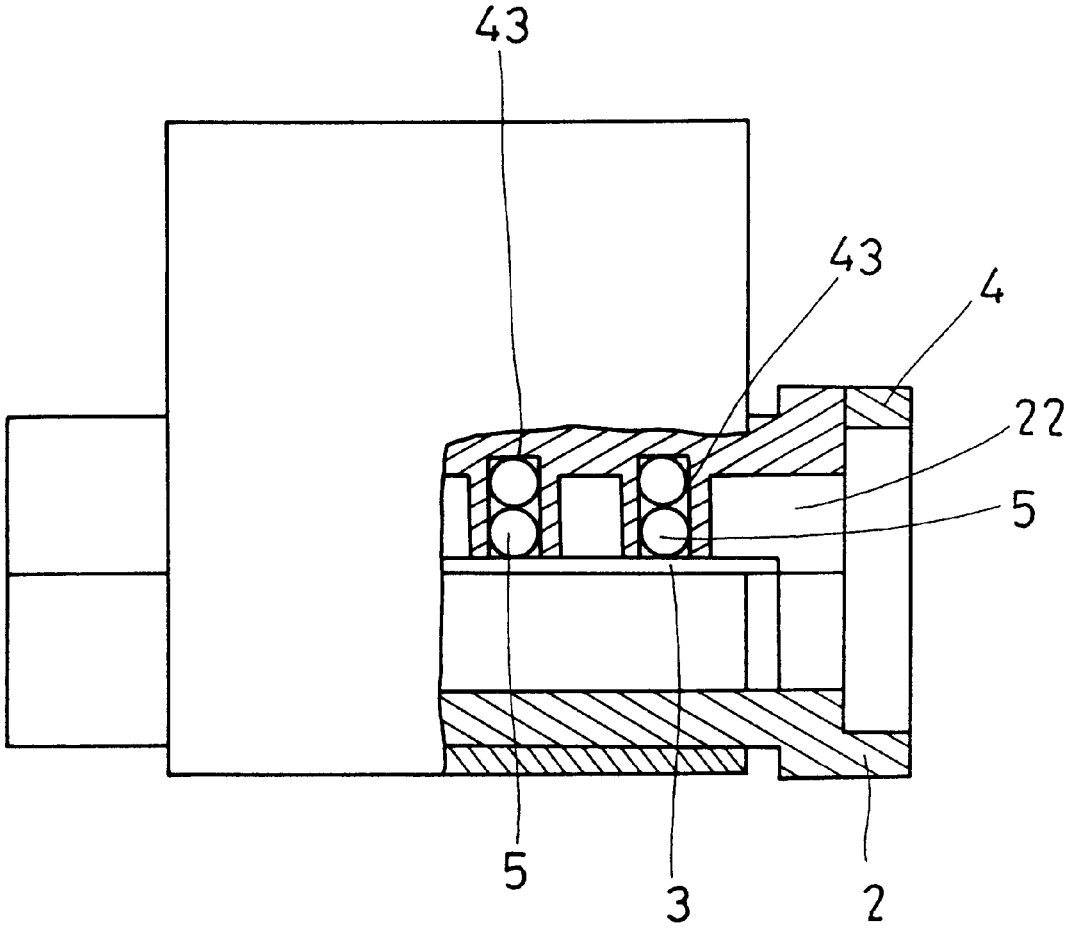

In assembling, as shown in FIGS. 2 and 3, the lock plate 3 is positioned on the lower cover 2, letting the insert holes 31 of the lock plate 3 match with the projections 21 of the lower lock cover 2. Then, the upper lock cover 4 is covered on the lower lock cover 2, letting the recessed hollow 41 of the upper cover 4 aligned to the lock plate 3 and the groove passage 20, 30, 40 of the lower lock cover 2, the lock plate 3 and the upper lock cover 4 match with one another. Lastly, the lower lock cover 2 and the upper lock cover 4 are fixedly assembled together by means of a clasp 7 tightly engaged in the clasping grooves 25, 24 of the lower and the upper lock cover 2, 4 to finish assembly of the lock core. Thus, when a burglar employs an electric drill to break and unlock a lock by drilling through the keyhole 22 of the lock, the electric drill will be stopped by the steel balls 5 in the recessed holes 43 of the upper lock cover 4 and in consequence, impossible to keep on drilling forward, having excellent effect of antitheft.

While the preferred embodiment of the invention has been described above, it will be recognized and understood that various modifications may be made therein and the appended claims are intended to cover all such modifications that may fall within the spirit and scope of the invention.

What is claimed is:

1. A lock core comprising a lower lock cover, a lock plate and an upper lock cover, said lower lock cover, said lock plate and said upper lock cover respectively formed with a curved groove passage, said lower lock cover having a keyhole at one end, said lock plate positioned between said lower and said upper lock cover, said upper lock cover assembled on said lower lock cover, said upper lock cover formed with a recessed hollow at a lower portion, said upper lock cover bored with a plurality of pin holes, said pin holes respectively receiving a locking pin therein; and, characterized by plural recessed holes bored in said recessed hollow of said upper lock cover, each said recessed hole fitted therein with at least one steel ball, said steel balls in said recessed holes able to stop an electric drill employed by a burglar from drilling forward, having excellent effect of anti-theft.

2. The lock core as claimed in claim 1, wherein said lower lock cover is provided with a plurality of projections on the upper side, said lock plate is bored with a plurality of insert holes matching with said projections, and said upper lock cover is provided with plural small recesses in said recessed hollow for fixing said lock plate in position.

3. The lock core as claimed in claim 1, wherein a notch is bored in the inner side of said keyhole for receiving an elastic clasp to clasp and hold a key.

4. The lock core as claimed in claim 1, wherein said lower lock cover is formed with a semi-annular clasping groove around an inner end, and said upper lock cover is provided with a semi-annular clasping groove around an inner end and a pin recess at on side edge, said clasping grooves of said upper and said lower lock cover corresponding to each other for a clasp to be tightly clasped therein, said pin recess of said upper lock cover receiving a locking pin therein.

* * * * *